United States Patent [19]

Bunn, Jr.

[11] 4,165,887

[45] Aug. 28, 1979

[54] CONTROLLED EXCURSION SKI BINDING WITH SAFETY RELEASE

[76] Inventor: Thomas C. Bunn, Jr., P.O. Box 121, Southport, Conn. 06490

[21] Appl. No.: 856,597

[22] Filed: Dec. 1, 1977

[51] Int. Cl.[2] ..... A63C 9/08

[52] U.S. Cl. ..... 280/613; 280/618; 280/622; 280/633; 280/636; 280/637

[58] Field of Search ..... 280/637, 618, 617, 616, 280/622, 626, 631, 632, 633, 634, 611, 613, 627, 636

[56] References Cited

U.S. PATENT DOCUMENTS

| | | | |
|---|---|---|---|
| 2,618,487 | 11/1952 | Gould | 280/622 |
| 3,055,673 | 9/1962 | Marker | 280/622 |
| 3,157,409 | 11/1964 | Gembruch, Jr. | 280/621 |
| 3,214,186 | 10/1965 | Spier | 280/620 |
| 3,527,468 | 9/1970 | Berchtold | 280/632 |
| 3,618,965 | 11/1971 | Hecker | 280/636 |
| 3,727,932 | 4/1973 | Druss et al. | 280/613 |
| 3,731,943 | 5/1973 | Wilkes | 280/613 |
| 3,825,274 | 7/1974 | Weinstein | 280/637 |
| 3,838,866 | 10/1974 | D'Alessio et al. | 280/614 |
| 3,871,674 | 3/1975 | Bunn, Jr. | 280/637 |
| 3,893,682 | 7/1975 | Weinstein et al. | 280/637 |
| 3,924,866 | 12/1975 | Schweitzer | 280/637 |
| 3,992,037 | 11/1976 | Frechin | 280/618 |
| 3,997,188 | 12/1976 | Begey | 280/637 X |
| 3,998,474 | 12/1976 | Marker et al. | 280/637 X |
| 4,008,907 | 2/1977 | Murata | 280/614 |
| 4,026,577 | 5/1977 | Frechin | 280/613 |
| 4,027,896 | 6/1977 | Frechin et al. | 280/613 X |

FOREIGN PATENT DOCUMENTS

| | | | |
|---|---|---|---|
| 2423702 | 11/1975 | Fed. Rep. of Germany | 280/636 |
| 2526822 | 12/1976 | Fed. Rep. of Germany | 280/618 |
| 1255073 | 1/1961 | France | 280/633 |

*Primary Examiner*—Joseph F. Peters, Jr.
*Assistant Examiner*—Milton L. Smith
*Attorney, Agent, or Firm*—Kenyon & Kenyon

[57] ABSTRACT

A ski binding having a boot attachment member connected to a ski mounting means by tensioned cables provides two modes of angular displacement, one mode of vertical displacement, and a safety release mode. The tensioned cables lead from guide means in one member to anchor points angularly spaced around a pivot means, the anchor points and the corresponding guide means being radially spaced from the circumference of the pivot means so that each tensioned cable leads in a straight line from its anchor point to its guide means throughout a predetermined angular displacement sector of the boot attachment member with respect to the ski mounting means. In this initial angular displacement sector, the resisting counter-torque is substantially constant. Subsequently, counter-torque increases with further angular displacement until safety release of the skier's boot from the boot attachment member occurs. A safety release device includes a heel clamp having a passageway adapted to receive an enlarged end of a cable connected to the boot attachment member. A locking pin fits slidably into a hole transversely intersecting the passageway and is adapted to be pulled out of interfering engagement with the enlarged end of the connecting cable, either manually by the skier or automatically in response to predetermined extension of the tensioned cables.

22 Claims, 16 Drawing Figures

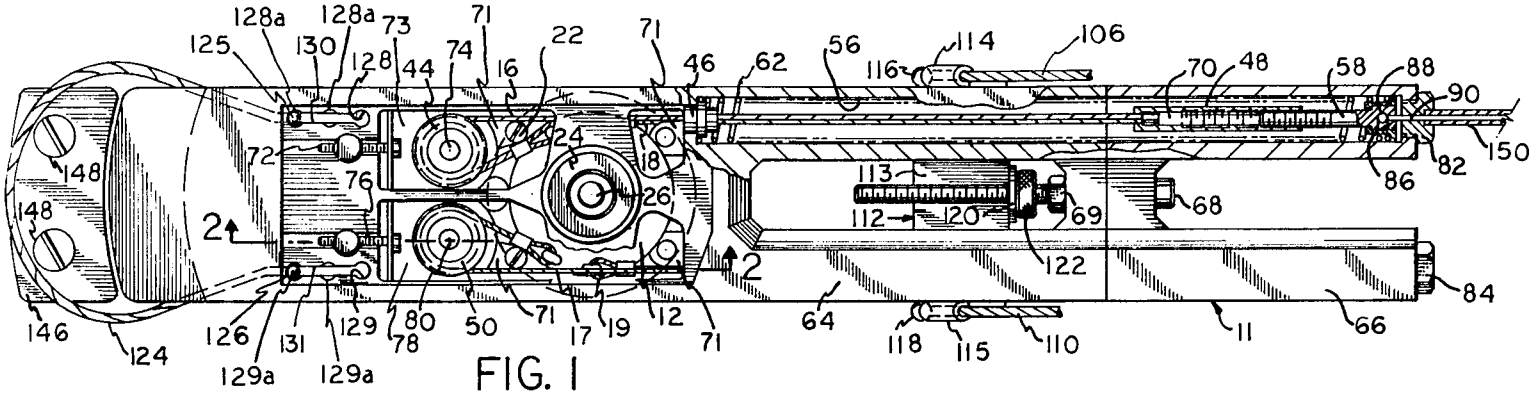
FIG. 1
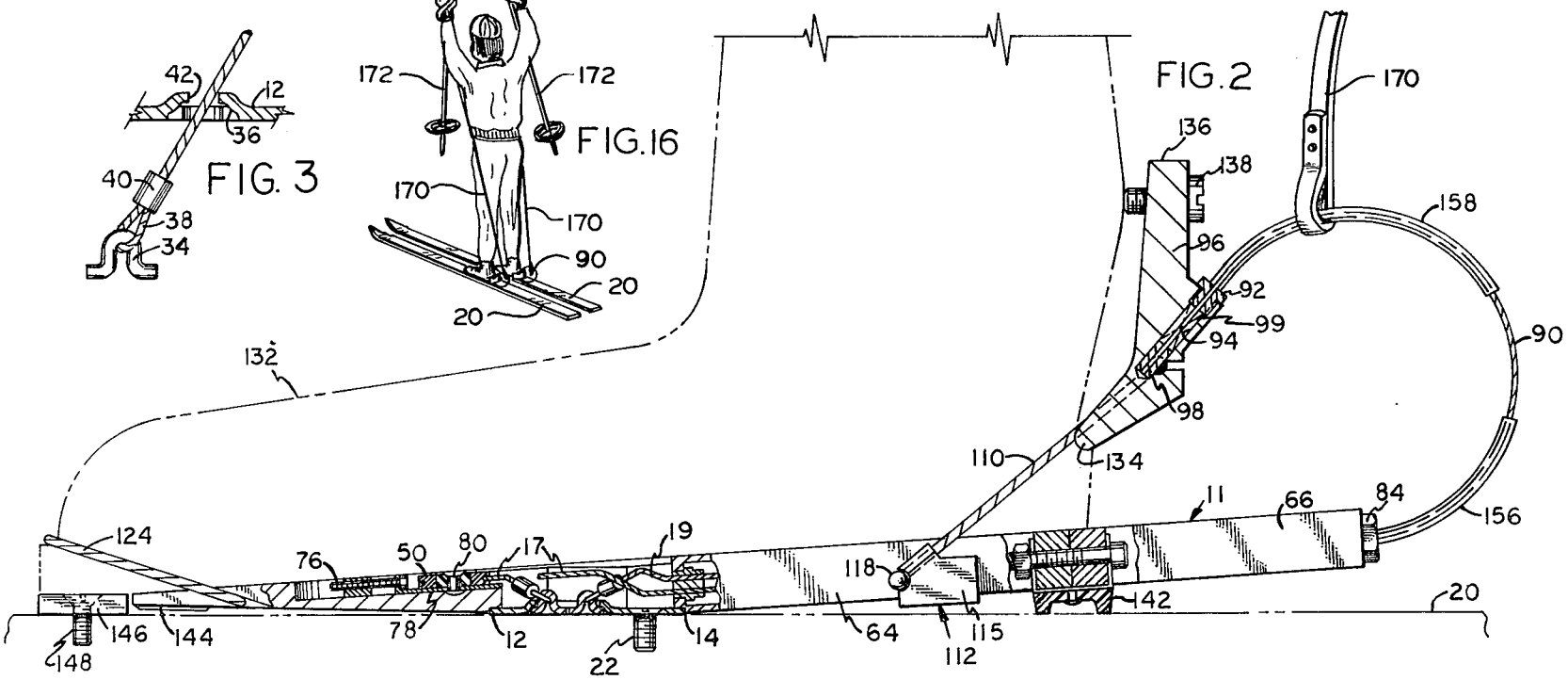
FIG. 2
FIG. 16
FIG. 3

CONTROLLED EXCURSION SKI BINDING WITH SAFETY RELEASE

BACKGROUND OF THE INVENTION

1. Field of the Invention

This invention relates to safety ski bindings and particularly to ski bindings of the type that includes a part attachable to a boot, a part attachable to a ski, and means for permitting controlled excursion of the part attached to the boot with respect to the part attached to the ski.

2. Description of the Prior Art

This invention represents an improvement over the ski safety device disclosed in my prior U.S. Pat. No. 3,871,674, issued Mar. 18, 1975. The safety ski binding disclosed in that patent comprises an elongated tread portion having means at the forward and rear ends for firmly clamping a ski boot thereto. A mounting plate for securing to the ski has upwardly projecting means interfitting with coacting means on the tread portion to permit rotary and lifting displacement of the tread portion with respect to the mounting plate, and pairs of tensioned cables extend from anchor points on the mounting plate spaced circumferentially with respect to the upwardly projecting means through guide means on the tread portion to tensioning means located in the tread portion.

In the embodiment disclosed in the patent, the coacting means on the tread member comprises a downward facing cylindrical cup that matingly engages the upwardly projecting means on the mounting plate. The guide means for the tensioned cables are pulleys mounted on the cylindrical outer surface of the cup, and the anchoring points for the tensioned cables are angularly displaced from the respective pulleys on a circle concentric with the upwardly projecting means and equal in diameter to the outer diameter of the cup. Any rotational displacement of the tread portion with respect to the mounting plate causes one of each pair of the tensioned cables to wrap around the circumference of the cup to produce increasing counter-torque as a linear function of the angle of rotation away from the equilibrium position.

In addition to rotational excursions, the safety binding of my prior U.S. patent also permits limited vertical excursions of the tread portion away from the mounting plate, such excursions being resisted by increasing tension in the cables as a function of the product of the spring rate and vertical excursion distance.

In subsequent tests of this binding, it has been found desirable to provide two modes of rotational excursion and also to provide means for releasing the skier's boot from the binding when the limits of excursion have been reached. Specifically, it has been found desirable to provide an initial rotational excursion mode in which the counter-torque remains substantially constant throughout a predetermined sector of rotation before the counter-torque begins to increase with increasing angle of rotation.

SUMMARY OF THE INVENTION

It is an object of the present invention, therefore, in a ski binding of the type having a boot engaging member connected to a ski mounting means by extendable tension means that permit limited, resiliently controlled, vertical and rotational excursions of the boot engaging member away from the ski mounting means to provide a single resistive mode for vertical excursions and two resistive modes for rotational excursions.

More specifically, it is an object to provide a ski binding of the type described in which a single resistive mode for vertical excursions produces a restoring force proportional to the tension in the tension means, a first resistive mode for rotational excursions produces an approximately constant restoring torque throughout a first displacement sector, and a second resistive mode for rotational excursions produces a restoring torque proportional to the tension in the tension means throughout a second, additional displacement sector.

A further object of the invention is to provide in a ski binding of the type described means for disconnecting a boot from a boot engaging member when a predetermined vertical or rotational excursion of the boot engaging member for a ski mounting means has been reached.

These and other objects are achieved by an improved safety ski binding of the controlled-excursion type having an elongated boot attachment member, mounting means adapted to be secured to a ski, pivot means interengaging the boot attachment member and the mounting means to permit rotary displacement of the boot attachment member about a fixed axis with respect to the mounting means, a plurality of attachment points angularly spaced about the axis of the pivot means on the ski mounting means, a corresponding plurality of guide means on the boot attachment member, tensioned cables each having one end attached to one of the attachment points on the ski mounting means and leading directly in a straight line to a corresponding guide means, and tensioning means connecting the other end of each cable to the boot attachment member.

The improvement of the present invention comprises positioning the attachment points and guide means in radially spaced relation to the circumference of the pivot means such that each tensioned cable leads directly in a straight line from its attachment point to the corresponding guide means throughout a predetermined initial angular displacement of the boot attachment member.

Although the extent of the predetermined initial angular displacement defining the first mode of rotational excursion may vary, an angular displacement range of approximately 45° in either direction from the neutral or zero displacement position is presently preferred. For displacements in excess of this initial angle, the binding operates in a second rotational excursion mode in which the resistive counter-torque increases with increasing angular displacement.

The angular range of the second rotational excursion mode may typically extend from approximately 45° to about 140°, or more, of rotation of the boot attachment member with respect to the ski mounting means in either direction from the neutral or zero displacement position. The range is not critical, however, and the limits can vary depending on the intended application of the binding and the extension capacity of the tensioning means.

The range of the first rotational excursion mode, and consequently the lower angular limit of the second mode, is determined by the maximum angular displacement of the boot engaging member with respect to the ski mounting means before the tensioned cables contact the circumference of the pivot means. From that point, further rotation causes the tensioned cable to wind around the circumference of the pivot means.

In mode one, even though the cable tension increases with increasing angle of rotation, in accordance with the spring rate of the tensioning means, the resistive counter-torque remains substantially constant because the lever arm through which the counter-torque acts decreases with increasing angle of displacement. As soon as the tension cable contacts the circumference of the pivot means, however, the lever arm remains constant, if the circumference of the pivot means is circular and concentric with the pivot axis. In such case the increase in counter-torque will be a direct linear function of the displacement angle (assuming a constant spring rate tension device).

In addition to providing a fixed axis of rotation for the boot engaging member, the presence of a pivot means of finite diameter provides a minimum lever arm for the tension cable, thereby assuring at all times a finite positive resisting torque in response to rotational displacement of the boot engaging member with respect to the ski mounting means.

Alternatively, it may be desirable to provide the pivot means with a variable radius (i.e., make it cam-shaped) so that the increase in resistive counter-torque with increasing angular displacement can be altered to other than a torque linearly proportional to the cable tension.

In a preferred embodiment the plurality of tensioned cables comprises two pairs of cables, each pair being connected to a corresponding tensioning means. The attachment points and respective guide means for each cable of a given pair are positioned so that the distance between the attachment point and guide means of one cable of the pair will increase with initial rotational displacement about the pivot axis in one direction, and the distance between the respective attachment point and guide means of the other cable of the pair will increase with initial rotational displacement in the other direction. In each case, the remaining cable of the pair will go slack as soon as any rotational displacement occurs, thus placing all tension exerted upon only one cable of each pair to restore the boot engaging member to a zero degree or neutral direction with respect to the ski attachment member. Upon restoration to zero degrees, each cable pair again shares the tension more-or-less equally.

As indicated above, the invention also comprises means for attaching a skier's boot to the boot engaging member and preferably means for disconnecting the attaching means when predetermined maximum vertical displacements and/or rotational displacements have been reached.

A specific embodiment of means for attaching a boot to the boot engaging member comprises means for engaging the sole of the boot, means for connecting the sole engaging means to the boot engaging member, and latching means for releasably attaching the connecting means to the sole engaging means. A preferred means for disconnecting the attaching means comprises an elongated tension member having one end connected to the latching means and another end connected to one pair of the tension cables, and an elongated compression member surrounding the tension member and extending between the sole engaging means and the boot engaging member.

The compression member has a predetermined compressibility in the longitudinal direction to permit a predetermined drawing out of the tension cable, and corresponding excursion by the boot engaging member with respect to the ski attachment member, before causing the tension member to unlock the latching means and detach the sole engaging means from the connecting means.

In a preferred embodiment the connecting means comprises a cable having an enlargement at one end, the sole engaging means comprises a heel clamp having a passageway adapted to receive the enlargement on the end of the connecting cable and a hole transversely intersecting the passageway, and the latching means comprises a locking pin that fits slidably into the hole in interfering engagement with the enlargement on the end of the connecting cable and is attached to the one end of the tension member, the locking pin being adapted to be pulled out of interfering engagement with said enlargement by said tension member upon further excursion after the compression member has reached its predetermined limit of compressibility.

In one preferred embodiment of the boot disconnecting member the tension member comprises a flexible cable, and the compression member comprises a flexible sleeve encasing the flexible cable, the length of the sleeve being less than the length of the tension member between the boot engaging member and the sole engaging means by said predetermined range of compressibility when the boot engaging member is in the neutral position with respect to the ski mounting means.

In an alternate embodiment of the boot disconnecting member, the tension member comprises a flexible cable, and the compression member comprises an open-coil spring encasing the flexible cable, the longitudinal spacing between adjacent coils of the spring and the number of coils determining the range of compressibility of said member.

Adjustment of the compressibility range of the sleeve-type compression member can be achieved simply by snapping a split ring of desired thickness onto the flexible cable to increase the effective length of the sleeve and thereby reduce the excursion possible before the latching means is unlocked. The spring-type of compression member may be equipped with an adjustable length screw sleeve to accomplish the same function.

The foregoing and other features of the invention will be described in more detail in connection with the preferred embodiments shown in the drawings.

BRIEF DESCRIPTION OF THE DRAWINGS

FIG. 1 is a top view of a preferred embodiment of the ski binding of the invention, with the boot attachment member partially cut away to illustrate the cable tensioning means.

FIG. 2 is a side view of the ski binding, partially in section taken along line 2—2 in FIG. 1.

FIG. 3 is a detail view showing the manner of attaching the cables to the ski mounting means.

FIG. 16 is a view of a skier actuating the boot release trigger.

DESCRIPTION OF THE PREFERRED EMBODIMENTS

Figures 4, 5, 6:
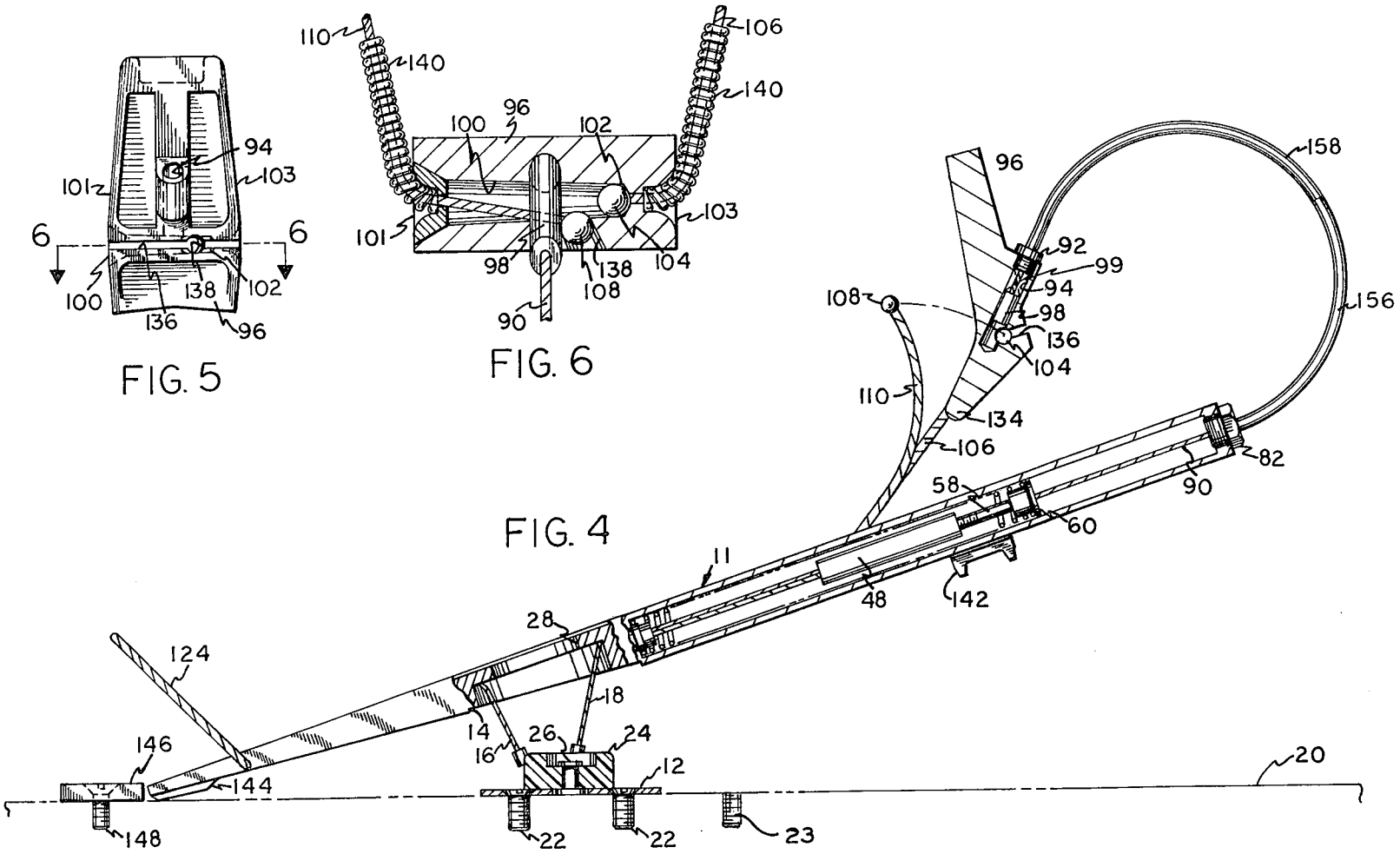
FIG. 4 is a side view of the ski binding, with the boot attachment member tilted upward away from the ski mounting means by a sufficient distance to trigger the boot heel clamp release mechanism.
FIG. 5 is a rear view of the boot heel clamp.
FIG. 6 is an enlarged section view of the boot heel clamp taken along line 6—6 in FIG. 5.

Referring to FIGS. 1 and 2, a preferred embodiment of the ski binding of the present invention includes an elongated boot attachment or engaging member 11 and an associated circular ski mounting means, in the form of a mounting plate 12. The mounting plate 12 is urged into a mating circular recess 14 in the bottom of the boot attachment member by four spring-tensioned cables 16, 17, 18 and 19. The ski mounting plate is adapted to be fastened to a conventional ski 20 by four screws 22 so that the longitudinal axis of the boot attachment member is aligned with the longitudinal axis of the ski when the tensions in the four attachment cables are in equilibrium.

The four screws 22 that attach the ski mounting plate to the ski are located at the corners of a rectangle, the adjacent sides of which are parallel and perpendicular, respectively, to the axis of the ski when the binding is properly mounted on the ski. This arrangement provides the important advantage that the ski binding can be shifted longitudinally with respect to the ski in increments equal to the longitudinal spacing between the transverse pairs of mounting screws merely by drilling two additional mounting holes 23 spaced lengthwise of the ski at a distance equal to the screw spacing from a previously-drilled pair of holes (see FIG. 4). In this way, adjustability of mounting position is possible with a minimum number of holes in the ski. Prior bindings use a triangular pattern of three screws, thereby requiring a complete set of new holes to be drilled if the mounting location is to be changed.

As shown more clearly in FIG. 4, a cylindrical pivot member 24 is attached to mounting plate 12 by a fastener such as rivet 26 or its equivalent. Pivot member 24 is preferably constructed of a non-metallic material having a low coefficient of friction such as polytetrafluoroethylene or nylon. The pivot member fits rotatably within a mating recess 28 located on the centerline of the boot attachment member. This arrangement allows the boot attachment member to rotate in a horizontal plane around the axis of the pivot member in response to torque forces imposed between the boot attachment member and the ski mounting plate. At the same time, the boot attachment member is free to separate from the ski mounting plate and pivot member in response to relative lifting forces exerted between the two.

Figure 7:
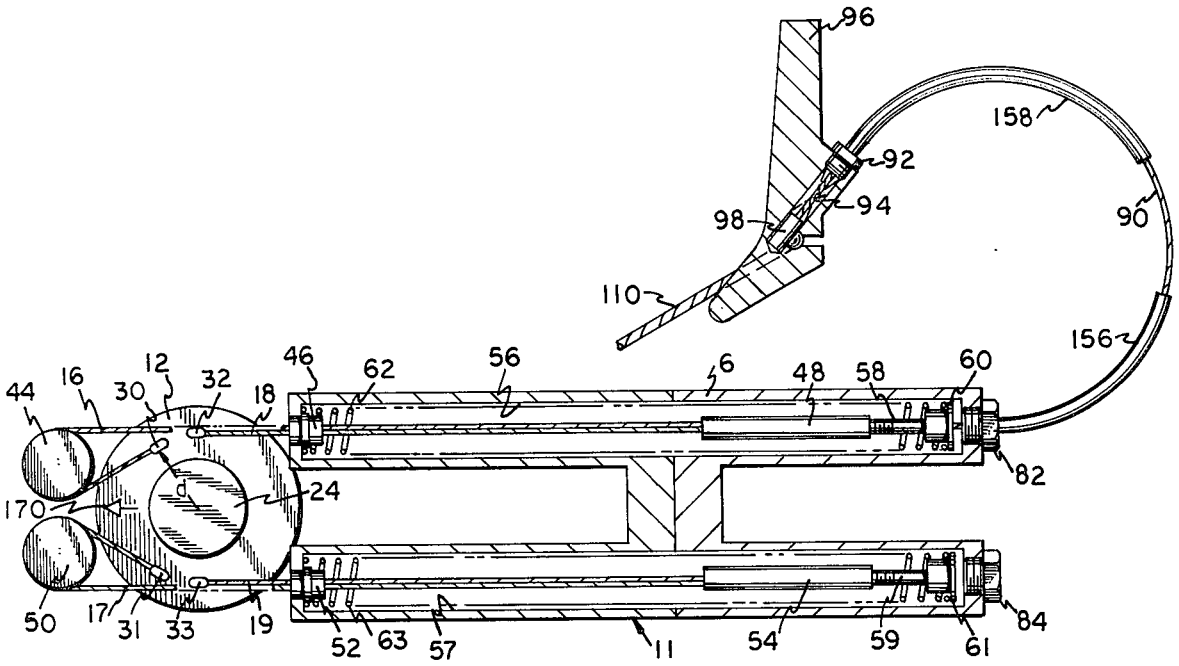
FIG. 7 is a simplified schematic top view of the ski binding showing the relationship between the ski mounting means, the cables attaching the boot attachment member to the ski mounting means, the cable tensioning means, and the boot heel clamp release mechanism, with the boot attachment member in the neutral equilibrium position with respect to the ski mounting means.

As shown in FIG. 7, in connection with FIGS. 1 and 2, the four cables 16–19 are attached to the ski mounting plate at locations 30, 31, 32 and 33, respectively. These four attachment points are angularly spaced around the ski mounting plate at equal distances d from the center of the plate.

Referring to FIG. 3, the cables are attached to the mounting plate by means of a simple bent wire clip 34 that fits within a mating dimpled recess 36 at each of the cable attachment points. Each of the cables has a loop 38 formed in one end and secured with a swaged clamp 40. The cables are assembled to the plate by passing the looped end through a hole 42 in the center of each recess 36, slipping a wire clip 34 into the loop, and then pulling the cable up through hole 42 until the clip 34 fits into recess 36. This method of attachment allows the cables to move in various directions without kinking or causing sharp bends and permits easy replacement of broken cables, but other attachment means can be used, if desired.

As is clear from FIGS. 1 and 7, cables 16 and 18 form a first pair on one side of the centerline of the ski binding, and cables 17 and 19 form another pair on the other side of the centerline of the binding. Cable 16 is led from its attachment point 30 around a pulley 44 and then rearwardly through a bushing 46 to an adjustable tubular anchor member 48. Cable 18 is led from its attachment point 32 through the same bushing 46 to the same anchor member 48. In a similar way, cable 17 is led from its attachment point 31 around a pulley 50 and through a bushing 52 to a tubular anchor member 54 identical to anchor member 48. In addition, cable 19 is led from its attachment point 33 also through bushing 52 to anchor member 54.

Bushing 46 is mounted in the forward end of an elongated spring chamber 56 on the one side of the boot attachment member, and bushing 52 is similarly mounted in the forward end of the spring chamber 57 on the other side of the boot attachment member.

Each of the tubular anchor members 48, 54 is internally threaded, and matingly threaded screw stops 58 and 59 are inserted into respective anchors 48 and 54. The end of screw stop 58 has a flange 60, and stop 59 has a similar flange 61. Flanges 60 and 61 engage the rear ends of coil compression springs 62 and 63, respectively. These springs extend forwardly through the chambers 56 and 57, respectively, to bear against the forward walls of the chambers, as shown.

With reference again to FIG. 1, boot attachment member 11 is constructed in two sections, a forward chassis 64 and a rear end cover 66. The chassis and end cover are fastened together with a cap screw 68 and nut 69.

One procedure for assembling the ski mounting plate to the boot attachment member is given as follows. First, end cover 66 is detached from chassis 64. A pair of cables 16 and 18 are cut to predetermined length, cable 16 being longer than cable 18. An anchor terminal 70 is swaged onto one end of each cable. The other end of each cable is guided through tubular anchor member 48, from rear to front, and then through the interior of coil spring 62 and through bushing 46. The two cables are pulled through anchor member 48 until terminals 70 seat against the front wall of the anchor member 48. Alternatively, anchor member 48 may be made full bore so that terminal 70 can be inserted into the front end and the front end of member 48 then swaged or crimped to a smaller internal diameter than the outer diameter of terminal 70.

Screw stop 58 is threaded into the rear of anchor member 48 and then the other ends of cables 16, 18 are inserted into the rear opening of spring chamber 56 in the chassis and pulled through until bushing 46 is seated in the forward end of chamber 56.

Loops are next formed in the other ends of cables 16 and 18, and coil spring 62 is compressed by suitable means to provide sufficient extra length of each cable to permit assembly to mounting plate 12 by the technique previously described in connection with FIG. 3, with care being taken to pass cable 16 around pulley 44 before it is attached to plate 12.

Cables 17 and 19 are assembled in a similar manner. The compression springs are then released to allow the cables to pull mounting plate 12 into mating engagement with recess 14 in the boot attachment member, with pivot member 24 nesting within recess 28.

It will be noted from FIGS. 1 and 2 that the cables are led upwardly from their respective attachment points on mounting plate 12 by guide means 71 attached to boot attachment member 11 so that the tension in each cable has a vertical component tending to hold the mounting plate firmly in contact with the boot attachment member with a predetermined force. In order to show clearly the path of the cables in FIG. 2, the guide means themselves (preferably formed as grooved pads of low-friction plastic or bronze) are not shown. Their location is apparent, however, from FIG. 1 and the abrupt changes in direction of the cables in FIG. 2.

Slight variations from design length of cables 16 and 18 due to manufacturing tolerances can be compensated for by use of adjusting screw 72 to move a sliding bracket 73 forward or rearward with respect to the chassis so as to equalize the tension in each cable when the boot engaging member is in the zero or neutral position with respect to the ski attachment member. Pulley 44 is rotatably secured to bracket 73 by axle post 74; so that forward movement of the bracket will take up any slack and then increase the tension in cable 16, and rearward movement will decrease the tension. Similar adjustment of the tension in cable 17 relative to cable 19 can be accomplished by use of adjustment screw 76 to move sliding bracket 78, which carries pulley 50 rotatably mounted on axle post 80.

After the tensions in each pair of cables have been equalized, the tension in cables 16, 18 should be adjusted to equal the tension in cables 17, 19 by appropriate adjustment of screw stop 58 and/or screw stop 59. End cover 66 can then be placed over the rear of the compression spring assemblies and attached to chassis 64 with screw 68 and nut 69. Subsequent readjustment of these assemblies is possible by obtaining access to screw stops 58 and 59 through bushing 82 and plug 84 in the rear ends of spring chambers 56 and 57, respectively. For example, further clockwise rotation of screw stops 58 and 59 in anchor members 48 and 54, respectively, will increase the initial force and torque required to displace the boot engaging member from the neutral position to accommodate the needs of skiers of greater weight or ability.

As shown by a cutaway section of screw stop 58 in FIG. 1, the head of stop 58 has a T-slot 86 which accommodates a conventional ball tip 88 swaged onto one end of a heel clamp release cable 90. Referring to FIG. 2, the other end of release cable 90 leads through a bushing 92 screwed into a blind hole 94 in the rear of a heel clamp 96, where it is swaged into a cylindrical locking pin 98 which is slidingly biased toward the bottom of hole 94 by a compression spring 99.

The construction of the heel clamp assembly and the clamp release mechanism is best shown in FIGS. 5 and 6, together with FIGS. 1 and 2. Blind hole 94 extends downward and forward from the rear of clamp 96 to intersect a transverse countersunk tapered hole 100 that extends from one side 101 of the heel clamp to a shoulder 102 spaced between the intersection of hole 94 and the other side 103 of the heel clamp.

The small diameter end of hole 100 adjacent to shoulder 102 is large enough to receive a ball tip 104 swaged onto one end of a first side tie-down cable 106, and shoulder 102 is spaced from locking pin 98 by a distance sufficient to accommodate another ball tip 108 between ball tip 104 and locking pin 98. The other ball tip 108 is swaged onto one end of a second tie-down cable 110. The other ends of tie-down cables 106 and 110 are attached to adjustable anchor means in the form of a bracket 112. The bracket has a flat base portion 113 extending transversely underneath boot attachment member 11 and having upturned ends 114 and 115 with upper margins curled over to form slotted receivers for the other ends of tie-down cables 106 and 110, respectively. The other ends of tie-down cables 106, 110 are also equipped with swaged ball tips 116, 118 to secure the cables to the bracket after they are inserted into the slotted receivers.

Bracket 112 is adjustably attached to the boot attachment member by an upturned lug 120 formed on the rear edge of base portion 113 and which fits slidably over the shank of cap screw 68. A knurled nut 122 threaded onto screw 68 provides forward and rearward adjustment of bracket 112 to adapt the heel clamping assembly to different sizes of ski boots.

The boot attachment member is also provided with toe holding means such as toe tie-down cable 124 having swaged ball tips 125 and 126 at its respective ends. Ball tips 125 and 126 can be inserted from below through holes 128 and 129, respectively, in the forward end of chassis 64. Holes 128 and 129 are connected to longitudinally spaced counterbored depressions 128*a* and 129*a* by slots 130 and 131, respectively. The slots are sized to pass cable 124 but not ball tips 125 and 126, which can be inserted into selected ones of the depressions, depending on the size of ski boot to be mounted on the binding. Other toe holding means, either fixed or adjustable, in common use can be substituted if desired.

Referring to FIG. 2, a ski boot (shown by dashed line 132) is mounted on the boot attachment member by inserting the front tip of the boot sole under the loop of toe tie-down cable 124, engaging lower end 134 of the heel clamp with the rear of the boot above the heel projection, and then lifting up on upper end 136 of the heel clamp until the tip of adjustment screw 138 snaps firmly against the counter of the boot. It will be noted from FIG. 2 that the line of pull of the heel tie-down cables passes slightly above the point of contact of the lower end of the heel clamp with the boot heel, thereby holding the boot firmly on the attachment member by a toggle action, yet allowing detachment by exertion of an outward and downward force on the top of the heel clamp.

Referring again to FIGS. 4, 5 and 6, heel clamp 96 is connected to tie-down cables 106 and 110 in the following manner. A lateral slot 136 just wide enough to pass the cable thickness extends across the back of the heel clamp and intersects the axis of hole 100. An additional hole 138 extends from the back of the heel clamp with its axis in the plane of slot 136 and intersecting the axis of hole 100 adjacent to locking pin 98.

Hole 138 is sized to accept ball tips 104 and 108, and the heel clamp is assembled by first inserting ball tip 104, with cable 106 leading through slot 136 toward side 103 of the heel clamp. Ball tip 108 is next inserted into hole 138 with cable 110 leading through slot 136 toward side 101 of the heel clamp. Shoulder 102 retains ball tip 104 in the hole against tension in cable 106, and locking pin 98 blocks ball tip 108 from being pulled through hole 100 by tension in cable 110. In order to protect the cables against fraying on the edges of the heel clamp and the boot heel, they may be enclosed in coiled protective members 140, if desired. These coiled members also desirably produce a nominal tension in cables 106 and 110 when the heel clamp assembly is not engaged with a boot, to prevent inadvertent disassembly.

As discussed previously, the improved ski binding of the present invention provides a different force-displacement characteristic for vertical displacement of the boot attachment member from the ski mounting plate than for rotational displacement. The action of the binding in response to vertical displacement forces will be described first, with reference to FIGS. 2 and 4.

In FIG. 2, the boot and binding are in their normal positions in relation to the ski. In these positions, a heel rubbing block 142 of low-friction plastic material attached to the bottom of the boot attachment member contacts the top surface of the ski, but a toe rubbing block 144 of the same or similar material under the forward end of the attachment member is spaced above the ski. The toe of the ski boot, however, extends beyond the forward end of chassis 64, and the bottom of the boot sole contacts a low-friction boot rubbing block 146 secured to the ski by screws 148. This arrangement enhances skiing "feel" through direct transmission of ski vibrations to the toe of the skier's boot.

Figure 11:
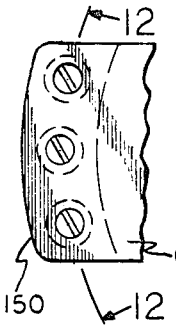
FIG. 11 is a plan view of the toe portion of an alternate embodiment of the boot engaging member of the invention.
Figure 12:
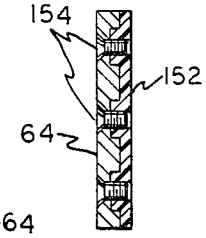
FIG. 12 is a section view taken along line 12—12 of FIG. 11.
Figure 13:
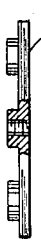
FIG. 13 is a side view of the plastic toe slide shown in section in FIG. 12.
Figure 14:
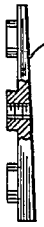
FIG. 14 is a side view of an alternate embodiment of a plastic toe slide for providing cant correction.

A more conventional arrangement is illustrated by FIGS. 11 and 12, in which the forward end of the boot is not intended to extend beyond the front tip 150 of chassis member 64. In this arrangement a low-friction rubbing pad 152 is secured to the underside of chassis 64 by flat-head machine screws 154. As shown in FIG. 13, the rubbing pad 152 has a uniform thickness for normal situations. For some skiers it may be desirable to tilt or cant the boot engaging member either inwardly or outwardly. This can be accomplished easily by replacing the standard rubbing pad 152 of FIG. 13 with a wedge-shaped pad 152', as shown in FIG. 14. Of course, the standard heel rubbing block 142 (see FIG. 2) should be replaced at the same time with a similarly wedge-shaped substitute block.

In the static condition illustrated by FIG. 2, the attachment cables 16, 17, 18, and 19 connect to the ski mounting plate at predetermined angles with the horizontal. The vertical "breakaway" force is determined by the preset tension in the cables multiplied by the sine of the predetermined angle. Both the sine of the angle and the tension in the cables increase with vertical displacement of the boot attachment member from the ski mounting plate, because the angle increases and the loading springs are compressed, as illustrated by the dynamic condition shown in FIG. 4.

The condition of FIG. 4 illustrates a situation resulting, for example, from a forward fall of the skier over the tips of the skis. In this condition a maximum extension of the attachment cables has been reached, and the tension in the cables has reached a value approaching the maximum stress on the leg of the skier permissible without risk of injury. In this condition, the binding provides an additional safety feature by releasing the boot completely from the ski. The release mechanism operates as follows.

Between bushing 82 at the rear of spring chamber 56 and bushing 92 in the rear of heel clamp 96, release cable 90 carries two sleeves 156 and 158 of flexible but relatively incompressible tubing. The combined length of sleeves 156 and 158 is less than the length of cable 90 extending between the two bushings in the static condition illustrated in FIG. 2. As the displacement of the boot attachment member from the ski mounting plate increases in response to increasing separation forces under a dynamic skiing situation, spring 62 becomes increasingly compressed. This draws release cable 90 into the spring chamber, and the gap between the sleeves, shown in FIG. 2, decreases until the sleeves abut. At this point, further compression of spring 62 causes cable 90 to withdraw locking pin 98 from interference with hole 100, thereby allowing ball tip 108 to "pop" out of the hole and disengage the heel clamp from the boot.

Figure 15:
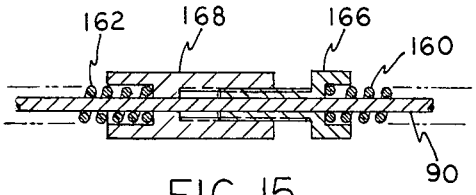
FIG. 15 is a partial view in section of an alternate embodiment of a safety boot release trigger cable.

Alternative means for providing the desired amount of free motion for cable 90 are illustrated in FIG. 15. In this arrangement, cable 90 is sheathed by open-coil springs 160 and 162. These springs extend from bushing 82 at the rear of the boot engaging member to bushing 92 at the heel clamp. The spacing between adjacent coils multiplied by the number of coils determines the compression range of the springs (i.e., the range of free motion of cable 90 before pin 98 is withdrawn). A screw bushing 164 comprising an externally threaded male member 166 and an internally threaded female member 168 permits adjustment of the compression range of springs 160, 162, depending on the size and skill of the skier, to provide a range of binding excursions before complete boot release occurs.

Although this final release results in separation of the boot from the ski, such release occurs only in an in extremis situation when release is necessary to prevent serious injury to the skier. Thus, the binding acts as a displacement type of binding to absorb relatively short duration impact stresses, without disengaging the boot from the ski but allowing the boot attachment member to return to properly aligned engagement with the ski mounting plate after the impact stress loading has passed. On the other hand, for longer duration or higher stress loads than can be safely absorbed by controlled displacement, the binding will release the boot completely.

The characteristics of the binding in absorbing torque stresses are illustrated by FIGS. 7 through 10. In FIG. 7 the binding is in a static condition, with no torque imposed between the boot attachment member and the ski mounting plate. This condition is indicated by the direction of arrow 170 on the mounting plate in alignment with the longitudinal axis of the boot attachment member.

In FIG. 7 each attachment cable preferably is led from its respective attachment point on plate 15 in a direction approximately perpendicular to a radius drawn to the attachment point. This arrangement provides the maximum effective moment arm for application of the tension force in each cable under static equilibrium conditions, when this tension force is at a minimum value due to maximum extension of the compression springs 62 and 63. On the other hand, the initial angle of cable pull (with respect to a radius line intersecting the attachment point) can be other than 90 degrees, if desired.

Figure 8:
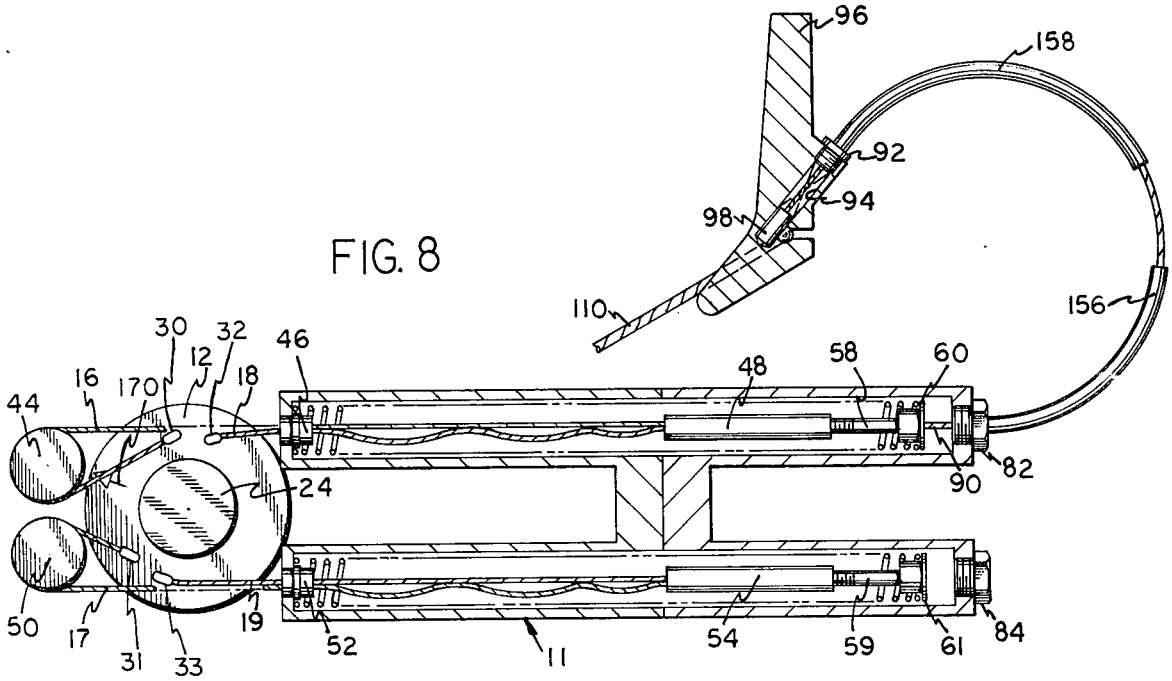
FIG. 8 is a view similar to FIG. 7, but with the ski mounting means rotated by relative torque forces approximately 20 degrees clockwise with respect to the boot attachment member, said forces being resisted by counter-torque forces exerted by tension in one of each cable pair.

FIG. 8 shows a condition in which the ski mounting plate has rotated approximately 20 degrees clockwise with respect to the longitudinal axis of the boot attachment member in response to a horizontal torque exerted between the boot and the ski. This rotation has caused cables 16 and 19 to draw out of the respective spring chambers, moving the cable anchors 48 and 54 forward in the chambers, and increasing the compression of springs 62 and 63, respectively. Cables 17 and 18, on the other hand, have gone slack.

Figure 9:
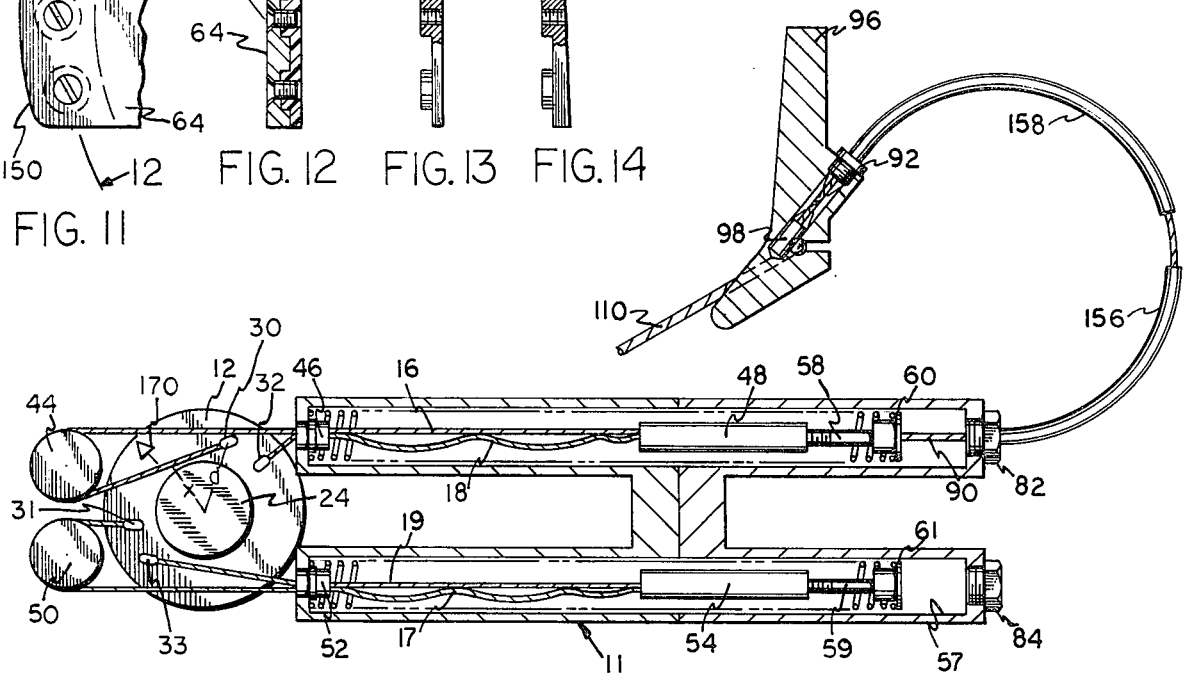
FIG. 9 is a view similar to FIG. 7, but with the ski mounting means rotated approximately 45 degrees clockwise with respect to the boot attachment member.

In FIG. 9, the ski mounting plate has rotated further clockwise to an angle of approximately 45 degrees with respect to the axis of the boot attachment member. This further rotation increases the compression of springs 62 and 63 and the corresponding tension in cables 16 and 19. At the same time, however, it will be noted that the effective moment arm x through which this tension acts has decreased from its maximum value (equal to d, the radial distance from the center of the mounting plate to the respective attachment points).

From a consideration of the geometry of the arrangement, it will be apparent that the tension in cables 16 and 19 has been increasing roughly by a sine factor while the effective lever arm has been decreasing approximately by a cosine factor. By appropriate selection of spring rate, initial cable pull angle, and initial cable tension, the increase in tension can be approximately counterbalanced by the decrease in effective moment arm, at least within a small range of rotation angles, so long as the tension cables are free to move inward toward the center of the mounting plate as the relative rotation takes place.

In FIG. 9, the tension cables are almost touching the pivot member after approximately 45 degrees of rotation.

Figure 10:
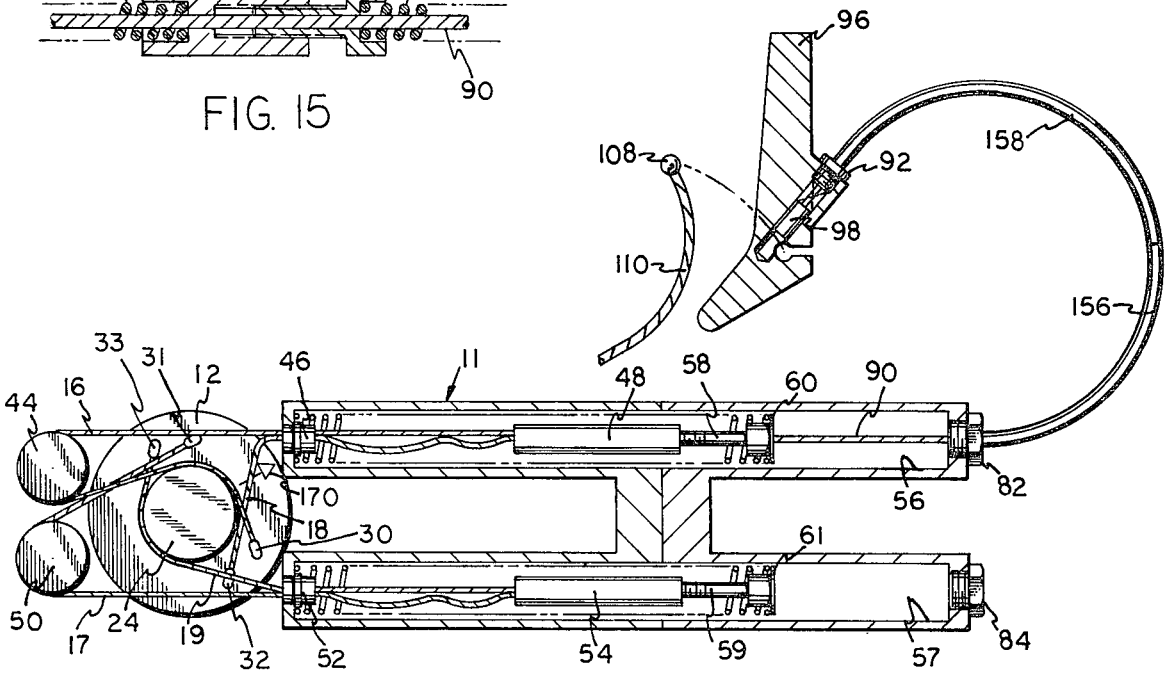
FIG. 10 is a view similar to FIG. 7, but with the ski mounting means rotated approximately 140 degrees clockwise with respect to the boot attachment member.

In the event that increasing torque forces cause still further rotation of the ski mounting plate with respect to the boot attachment member, the tension cables come in contact with pivot member 24 and begin to wrap around it. This condition is illustrated by FIG. 10, in which relative rotation of approximately 140 degrees has occurred.

As soon as the tension cables contact the side of the pivot member, the change in torque exerted by the tension cables becomes a linear function of rotation angle. Thus, any further rotation beyond about 45 degrees results in approximately linearly increasing restoring torque (as modified by friction and inertia) up to a maximum rotation angle limited by the total possible spring travel. For practical purposes, this maximum angle may be about 140° to 180°.

At this maximum angle (shown in FIG. 10) it will be noted that the gap between sleeves 156 and 158 on release cable 90 has disappeared. Locking pin 98 has thereby been withdrawn from the bore of hole 100, allowing ball tip 108 on the end of tie-down cable 110 to pop out of the hole and disengage the boot from the boot attachment member.

It will be appreciated, of course, that the above rotation angles are only illustrative and that the torque-displacement and boot release characteristics of the binding can be tailored to meet specific design requirements by proper selection of tension cable attachment location, pivot member diameter, spring rate, initial cable tension, and initial gap between sleeves 156 and 158.

It will be further appreciated that the principle of the present invention can be adapted for use with other types of cable tensioning means, such as clock springs, a series of belville springs, or pneumatic cylinders. In addition, the controlled torque feature of the invention can be used with or without releasable clamping devices, if desired, and vice-versa.

The differential between resistance to displacement force and return force (vertical) and return-to-center force (rotational) for the binding of the present invention is very slight, resulting only from friction and inertia. Thus with vertical return and rotational return-to-center forces nearly equal to the forces which displace the binding during skiing maneuvers, the binding is working at nearly 100% efficiency to prevent unnecessary excursions. Heretofore, bindings have had rather low return-to-center efficiency, ranging according to some reporters from 30% to 60%, except for bindings with very limited operating ranges (in terms of distance before total disengagement) which showed higher efficiency, but over such a slight distance that the skier still had to employ tension settings on all these bindings approaching the elastic limit of the skier's leg. Any slight malfunction, or any increase in friction or misinstallation could cause the skier to exceed the elastic limit of the leg.

The present binding operates in a range of tension settings, due to its high efficiency over large angles of displacement, which are only 50% of the tension settings necessarily employed on other bindings, thus providing the skier with far greater margins of safety, no unessential releases, return-to-center and vertical return after releases within a large range, and disconnection from the binding at a predetermined displacement point of the skier's choosing.

In addition to providing automatic release at a predetermined displacement of the boot engaging member, as adjustable by the skier, the heel clamp locking device of the present invention also permits release at will by the skier in skiing situations, such as an avalanche, when immediate release from the skis is essential. Because release cable 90 extends upwardly and rearwardly in a large open loop (see, for example, FIG. 2, it can be grasped easily by the skier by bending his knees. A sharp tug on the cable will then pull pin 98 out of interfering engagement with enlargement 108, thereby freeing the skier's boot from the boot attachment member.

Alternatively, the release mechanism can be equipped with a leash 170 (see FIG. 2) attached at one end to the release cable and at the other end to a convenient location such as the skier's belt or, preferably, to a corresponding ski pole 172 as illustrated by FIG. 16 on Sheet 1 of the drawings. In the latter case, the leash is made long enough so that release will occur only when the skier raises his arms high over his head while holding the poles. This arrangement guards against inadvertent release during normal skiing maneuvers.

Although the preferred embodiment of the ski safety binding of this invention incorporates the tension means in the boot attachment member, it is considered fully equivalent to reverse the design and place the tension means on a ski. A prototype version has been constructed, for example, having two tension devices mounted on a ski, one in front of the binding and one to the rear of the binding. Each tension device was attached to a pair of cables, which were led through guide means to respective attachment points on the boot attachment member.

Another prototype design placed one tension device in the forward section of the boot attachment member and a second tension device in the rear of the boot attachment member.

Still another prototype design used only a single tension device and one pair of tension cables. These and other variations and equivalents are considered to be included within the scope of the invention in accordance with the following claims.

I claim:

1. A safety ski binding of the controlled-excursion type having an elongated boot attachment member, mounting means adapted to be secured to a ski, pivot means interengaging the boot attachment member and the mounting means to permit rotary displacement of the boot attachment member about an axis fixed with respect to the mounting means, a plurality of attachment points angularly spaced about the axis of the pivot means on one of the boot attachment member and the mounting means, a plurality of guide means corresponding to the attachment points and located on the other of the boot attachment member and the mounting means, a plurality of elongated tensioned cables each having one end attached to a corresponding one of the attachment points and leading to the corresponding one of the guide means, and at least one spring tensioning means connecting the other end of each cable to the other of the boot attachment member and the mounting means, wherein the improvement comprises the attachment points and guide means being spaced radially outward from the circumference of the pivot means such that each tensioned cable leads directly in a straight line from the respective attachment point to the corresponding guide means throughout a preselected angular displacement sector of the boot attachment member from a neutral position in which no external torque is applied with respect to the mounting means.

2. A safety ski binding according to claim 1 wherein the plurality of tensioned cables comprise at least one pair of cables, the one end of one of said pairs of cables leading clockwise from the respective guide means to the corresponding attachment point; the one end of the other of said pair of cables leading counterclockwise from the respective guide means to the corresponding attachment point, and the other ends of both cables of said pair being connected to the same tensioning means, the tension in each of said pair of cables being equalized when no external torque is applied between the boot attachment member and the mounting means.

3. A safety ski binding according to claim 2, wherein the one of said pair of tensioned cables comes into tangential contact with the external circumference of the pivot means when angular displacement of the boot attachment member from said neutral position with respect to the mounting means exceeds the preselected angular displacement sector in the counterclockwise direction, and the other of said pair of tensioned cables comes into tangential contact with the external circumference of the pivot means when angular displacement of the boot attachment member from said neutral position with respect to the mounting means exceeds the preselected angular displacement sector in the clockwise direction.

4. A safety ski binding according to claim 2 comprising means for adjusting one of said at least one pair of cables in relation to another of said pair of cables so that the tension in each of said pair of cables is equalized when the boot attachment member is oriented at a predetermined angle with respect to the ski mounting means.

5. A safety ski binding according to claim 2 comprising two of said pairs of cables and two of said tensioning means, both cables of one pair being connected to one of the tensioning means and both cables of the other pair being connected to the other of the tensioning means; a first means for adjusting one cable of the one pair in relation to the other cable of the one pair; and a second means for adjusting one cable of the other pair in relation to the other cable of the other pair so that the tensions in each pair of cables are equalized when the boot attachment member is oriented at said predetermined angle with respect to the ski mounting means.

6. A safety ski binding according to claim 5 wherein said first and second adjusting means comprise first and second pulleys contacting the respective one cable of each pair of cables and first and second means for adjustably translating said respective first and second pulleys transversely to the contacted cables so that the tension in the one cable of each pair can be equalized with the tension in the other cable of each pair when the attachment member is oriented at said predetermined angle.

7. A safety ski binding according to claim 1 further comprising means for attaching a skier's boot to the boot attachment member and means for disconnecting said attachment means if displacement of the boot attachment member with respect to the mounting means exceeds a preselected extension of one of said tensioning means.

8. A safety ski binding according to claim 1 further comprising means for attaching a skier's boot to the boot attachment member and means for disconnecting said attachment means if angular displacement of the boot attachment member from said neutral position with respect to the mounting means exceeds a second preselected angular displacement sector.

9. A safety ski binding comprising:

a boot attachment member;

mounting means adapted to be secured to a ski;

elongated extensible means connecting the boot attachment member to the ski mounting means;

biasing means for retracting the extensible means to urge the boot attachment member into aligned engagement with the ski mounting means;

means for attaching a skier's boot to the boot attachment member including means for engaging a sole of a boot, means for connecting the sole engaging means to the boot attachment member, and locking means connected to said extensible means for releasably attaching the connecting means to the sole engaging means; and means for disconnecting the attaching means if displacement of the boot attachment member from said aligned engagement with the ski mounting means exceeds a preselected extension of said extensible means, said disconnecting means including an elongated tension member, having one end connected to the locking means and another end connected to the extensible means, and an elongated compression member, surrounding the tension member and extending between the sole engaging means and the boot attachment member, the compression member having a predetermined compressibility in the longitudinal direction corresponding to a displacement equal to said preselected extension of said extensible means.

10. A safety ski binding according to claim 9 wherein the elongated tension member comprises a flexible cable, and the elongated compression member comprises a flexible sleeve, the length of the sleeve being less than the length of the flexible cable by an amount equal to said predetermined compressibility.

11. A safety ski binding according to claim 9 wherein the elongated tension member comprises a flexible cable, and the elongated compression member comprises an open-coil spring encasing the flexible cable, the longitudinal spacing between coils and the number of coils determining said compressibility.

12. A safety ski binding according to claim 9 comprising means for adjusting the force exerted by the biasing means for retracting the extensible means, said adjusting means including:

a first member in fixed contact with the biasing means;

a second member attached to the extensible means, the first member being adjustably movable with respect to the second member; and means for attaching the other end of the elongated tension member to said first member, such that adjustment of the first member with respect to the second member produces an equivalent adjustment in the predetermined compressibility of said elongated compression member.

13. A safety ski binding according to claim 9 comprising means for adjusting the predetermined compressibility of said compression member.

14. A safety ski binding according to claim 9 wherein the means for connecting the sole engaging means to the boot attachment member comprises a flexible cable having an enlargement at one end;

the means for engaging a sole of a boot comprises a heel clamp having a passageway adapted to receive the enlargement on the end of the flexible cable and a hole transversely intersecting the passageway; and the locking means comprises a locking pin that fits slidably into the hole in interfering engagement with the enlargement on the one end of the flexible cable, the other end of the flexible cable being secured to the boot attachment member.

15. A safety ski binding comprising:

a boot attachment member;

means for connecting the boot attachment member to a ski;

a first cable having an enlargement at one end and being attached at the other end to one side of the boot attachment member;

a heel clamp for engaging the sole of a skier's boot, the clamp having a passageway adapted to receive the enlargement on the one end of the first cable and a hole transversely intersecting the passageway;

a second cable having one end attached to the heel clamp and the other end attached to the other side of the boot attachment member;

a locking pin that fits slidably into the transverse hole in interfering engagement with the enlargement on the one end of the first cable; and means attached to the locking pin and adapted to be pulled by a skier to withdraw the locking pin from interfering engagement with said enlargement for releasing the skier's boot from the binding.

16. A safety ski binding according to claim 15 wherein the means attached to the locking pin comprises a leash and means for attaching the leash to a ski pole, the length of the leash being such that the skier can pull the locking pin out of interfering engagement with said enlargement by extending his arms high over his head while holding the ski pole.

17. A safety ski comprising an elongated boot attachment member, means for connecting said member to a ski and means for attaching a skier's boot to the boot attachment member, said last-mentioned means including a plurality of spaced depressions on either side of the boot attachment member adjacent one end thereof, a slot connecting the spaced depressions on each side of the boot attachment member, a length of flexible cable having enlargements at each end, each enlargement being adapted to fit into a selected one of the depressions on a respective side of the boot attachment member, the slot being wide enough to permit free passage of the length of cable but not the enlargement at either end of the cable, and an opening in the slot large enough to pass the enlargement at either end of the cable, whereby the enlargement at each cable end can be inserted through the respective opening and fitted into a selected one of the depressions connected by the respective slot with the cable looped over the sole at one end of a skier's boot, the plurality of spaced depressions permitting selective adjustment for different boot lengths.

18. A safety ski binding according to claim 17 wherein said one end of the boot is the toe end.

19. A safety ski binding comprising:

a boot attachment member;

mounting means adapted to be secured to a ski;

elongated extensible means connecting the boot attachment member to the ski mounting means;

biasing means for retracting the extensible means to urge the boot attachment member into aligned engagement with the ski mounting means;

means for attaching a skier's boot to the boot attachment member; and a bearing member of low friction material detachably fitted to the bottom of the boot attachment member for providing low friction sliding contact between the bottom surface of the bearing member and the top surface of a ski to which the mounting means is secured, said bottom surface of the bearing member being canted transversely with respect to the top surface of the boot attachment member by a preselected number of degrees according to the requirements of an individual skier.

20. A safety ski binding of the controlled-excursion type having an elongated boot attachment member, mounting means adapted to be secured to a ski, pivot means interengaging the boot attachment member and the mounting means to permit both rotary displacement of the boot attachment member about an axis fixed with respect to the mounting means while in contact therewith and separation of the boot attachment member from the mounting means, a plurality of attachment points angularly spaced about the axis of the pivot means on one of the boot attachment member and the mounting means, a plurality of guide means corresponding to the attachment points and located on the other of the boot attachment member and the mounting means, a plurality of elongated tensioned cables each having one end attached to a corresponding one of the attachment points and leading to the corresponding one of the guide means, and at least one spring tensioning means connecting the other end of each cable to the other of the boot attachment member and the mounting means, wherein the improvement comprises means for releasably attaching a skier's boot to the boot attachment member, said releasable attachment means being adapted to release automatically the boot from the boot attachment member.

21. A safety ski binding according to claim 20 wherein the releasable means comprises means for automatically releasing a boot from the boot attachment member in response to predetermined rotation of the boot attachment member with respect to the mounting means and to predetermined displacement of the boot attachment member away from the mounting means.

22. A safety ski binding of the controlled-excursion type having an elongated rigid boot attachment member, mounting means adapted to be secured to a ski, pivot means interengaging the boot attachment member and the mounting means intermediate the ends of the boot attachment member to permit rotary displacement of the boot attachment member about an axis fixed with respect to the mounting means, a plurality of attachment points angularly spaced about the axis of the pivot means on one of the boot attachment member and the mounting means, a plurality of guide means corresponding to the attachment points and located on the other of the boot attachment member and the mounting means, a plurality of elongated tensioned cables each having one end attached to a corresponding one of the attachment points and leading to the corresponding one of the guide means, at least one spring tensioning means connecting the other end of each cable to the other of the boot attachment member and the mounting means, and means for attaching a skier's boot to the boot attachment member, wherein the improvement comprises a first low-friction member extending from the under surface of the boot attachment member at a first predetermined distance forward of the pivot means;

a second low-friction member extending from the under surface of the boot attachment member at a second predetermined distance to the rear of the pivot means, said first and second low-friction means being adapted to serve as fulcrums in contact with the upper surface of a ski about which the boot attachment member will pivot in response to forces tending to cause a skier to fall forwardly or rearwardly, respectively; and means coupled to at least one of said tensioned cables for automatically releasing said boot attachment means for disengaging a skier's boot from the boot attachment member in response to predetermined displacements of the boot attachment member with respect to the mounting means about said fixed axis and about said first and second low-friction members.

* * * * *